US007336918B2

(12) United States Patent
Tsujita

(10) Patent No.: US 7,336,918 B2
(45) Date of Patent: Feb. 26, 2008

(54) IMAGE FORMING DEVICE HAVING A DRUM SEPARATION DEVICE

(75) Inventor: Mitsuji Tsujita, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 168 days.

(21) Appl. No.: 11/258,206

(22) Filed: Oct. 26, 2005

(65) Prior Publication Data

US 2007/0092310 A1 Apr. 26, 2007

(51) Int. Cl.
*G03G 15/16* (2006.01)

(52) U.S. Cl. ..... 399/315

(58) Field of Classification Search ..... 399/315
See application file for complete search history.

(56) References Cited

U.S. PATENT DOCUMENTS 4,699,499 A * 10/1987 Hoshika et al. ..... 399/315
4,739,363 A * 4/1988 Hoshika et al. ..... 399/315
4,782,358 A * 11/1988 Shibayama et al. ..... 399/97
5,890,030 A * 3/1999 Namekata et al. ..... 399/66
6,256,465 B1 * 7/2001 Yoshinaga et al. ..... 399/103
2002/0106575 A1 * 8/2002 Akashi et al. ..... 430/125

FOREIGN PATENT DOCUMENTS

JP 11084903 A * 3/1999

* cited by examiner

*Primary Examiner*—Quana Grainger
(74) *Attorney, Agent, or Firm*—Global IP Counselors, LLP

(57) ABSTRACT

A separation device 16, which is located downstream from a transfer roller in the sheet transport direction, applies a separation voltage to a plurality of separation needles 17 disposed in an alignment orthogonal to the direction of transport of the sheet, so as to produce a discharge between a photosensitive drum 2 and the separation needles 17 and to remove the charge on the sheet that was charged by a transfer roller, so as to separate the sheet from the photosensitive drum 2, the separation device 16 having an upstream wall 27 and a downstream wall 28, and a ground electrode 33 being disposed on the back side of the downstream wall 28, which is the side not facing the separation needles 17, and protruding towards the photosensitive drum 2, beyond the line that connects the tips of the separation needles 17 and the end of the downstream wall 28.

9 Claims, 8 Drawing Sheets

| | Comparative Example 1 | | | | | | Embodiment | | | | | | Comparative Example 2 | | |
|---|---|---|---|---|---|---|---|---|---|---|---|---|---|---|---|
| Ground Electrode | No | | | | | | Yes | | | | | | Yes | | |
| a | 0.5 | 2 | 2 | 1.5 | 2.5 | 1.5 | 0.5 | 1 | 2 | 1.5 | 1.5 | 2 | 0.5 | 1.5 | 1.5 |
| b | 1 | 1 | 1.5 | 1 | 2 | 3 | 1.5 | 1.5 | 1 | 1 | 1.5 | 2 | 1 | 1.5 | 3 |
| a + b | 1.5 | 3 | 3.5 | 2.5 | 4.5 | 4.5 | 2 | 2.5 | 3 | 2.5 | 3 | 4 | 1.5 | 3 | 4.5 |
| c | 0 | 0 | 2.5 | 0 | 0 | 0 | 0 | 0 | 0 | 0 | 2 | 0 | 0 | 2.5 | 0 |
| Safety | good | good | good | poor | poor | poor | good | good | good | good | good | good | good | good | poor |
| Separation | good | good | poor | good | good | good | good | good | good | good | good | good | good | poor | good |
| Life | poor | poor | good | poor | very good | good | good | good | good | good | good | good | poor | good | good |

(numerals represent mm)

*Fig. 6*

| | Comparative Example 1 | | | | | Embodiment | | | | | | Comparative Example 2 |
|---|---|---|---|---|---|---|---|---|---|---|---|---|
| Separation Needle Interval (mm) | 2 | 2.4 | 3 | 5 | 1 | 2 | 2.4 | 3 | 5 | 6 | 7 | 8 |
| Ground Electrode | No | No | No | No | Yes | Yes | Yes | Yes | Yes | Yes | Yes | Yes |
| Discharge Voltage (KV) | 6.0 | 5.4 | 5.0 | 4.5 | 6.0 | 5.5 | 5.0 | 4.5 | 4.2 | 4.2 | 4.2 | 3.8 |
| Separation | good | good | good | good | good | good | good | good | good | good | good | poor |
| Discharge Uniformity | poor | possible (good) | possible (good) | good (good) | poor | possible (good) | possible (good) | good (good) | excellent (good) | excellent (good) | excellent (good) | excellent (good) |

(discharge output 40 A)

*Fig. 7*

IMAGE FORMING DEVICE HAVING A DRUM SEPARATION DEVICE

FIELD OF THE INVENTION

The present invention relates to an image forming device such as a copier, a printer or a facsimile machine, and more specifically it relates to an image forming device wherein a sheet of recording media can easily be separated from an image bearing member after toner image transfer by removing a charge therefrom.

BACKGROUND INFORMATION

In general, electrophotographic image forming devices such as copiers, printers and facsimile machines form a toner image on, or transfer a toner image to, the surface of an image bearing member such as a photosensitive drum or an intermediate transfer member, and after transferring the toner image, which was formed on, or transferred to, the surface of this image bearing member, to a recording media (such as copy paper or plastic film) the recording media is separated from the surface of the image bearing member by a separation means, the recording media that has been separated from the image bearing member is fed into a fixing means, and after the toner image is fixed on the recording media by this fixing means, the fixed recording media is transported to an output tray or an intermediate tray for two-sided printing.

Examples of known separation means for such image forming devices include charge removal separation systems such as shown in FIG. 8, charge removal separation systems such as shown in FIG. 9 and charge removal separation systems such as shown in FIG. 10. Therein, the separation means 100, 101 shown in FIG. 8 and FIG. 9 are such that separation needles 102, 103 are held by an upstream wall 104, 105, which is positioned upstream in the direction of transport of the recording media, and a downstream wall 106, 107, which is positioned downstream in the direction of transport of the recording media; a plurality of the separation needles 102, 103 being disposed orthogonal to the direction of transport of the recording media (hereinafter referred to as the paper travel transverse direction). Furthermore, the separation means 108 shown in FIG. 10 are such that a separation needle 110 having a plurality of discharge tips 110*a* at predetermined intervals in the lengthwise direction of an image bearing member 114 is disposed downstream from a transfer charger 109, in the direction of sheet transport, facing the image bearing member 114, so that when a voltage is applied to this separation needle 110, discharge current flows from the separation needle 110, so that the recording media 112 separates from the image bearing member 114.

Among these separation devices 100, 101 and 108 for image forming devices, the separation means 100 disclosed in FIG. 8 is such that, at a predetermined timing after transferring the toner image to the recording media 111, a separation voltage is applied to the separation needles 102, whereupon corona discharge is generated between the separation needles 102 and the image bearing member 113, so that the electrostatic charge applied to the recording media 111 by the transfer roller 117 during the transfer operation is removed, whereby the recording media 111 separates from the image bearing member 113 as a result of the weight and the elastic resilience of the image recording media 111.

Furthermore, with the separation means 101 disclosed in FIG. 9, excess charge is discharged to the grounded separation needle 103 from the back side of the recording media 115, so as to remove the electrostatic charge applied to the recording media 115 by the transfer roller 120 during the transfer operation. Thus, if the elastic resilience of the recording media 115 itself is strong, it is possible for charge removal separation between the recording media 115 and the image bearing member 116 to be performed well, even in cases where a conventionally known separation means 101 such as disclosed in FIG. 9 is used.

Furthermore, the separation means 108 disclosed in FIG. 10 are such that after a toner image on an image bearing member at 114 has been transferred to the recording media 112, the recording media 112 is separated from the image bearing member 114, but the conditions for separation at this time are the application of a predetermined voltage to the separation needle 110 and a predetermined gap size between the separation needle 110 and the image bearing member 114, whereby, when a transfer corona is generated by the transfer charger 109, the peripheral impedance changes and a discharge current can be observed from the separation needle 110, so that the recording media 112 separates well from the image bearing member 114.

It is of note that in recent years, with a view to efficient use of resources and protection of the environment, printing is often performed on both sides of the recording media. In such cases of printing on both sides of the recording media, there is a risk that the recording media 115 will not separate well from the image bearing member 116 with conventional separation means 101 such as shown in FIG. 9. Here, modes of printing on both sides of the recording media 115 include, not only two-sided printing wherein, after printing on one side of the recording media 115, the printing media 115 having one printed side is reversed to the back side using a two-sided printing unit or the like, and printing is continued on the other side of the printing media 115 which has not yet been printed, but also modes wherein, after printing on one side, the recording media 115 is reused as copy paper or the like, and printing is performed on the unprinted side of that reused printing media 115.

In other words, when such two-sided printing is performed, there is a tendency for the curl in the recording media 115, which is copy paper or the like, to be larger than the curl in the recording media 115 when only one-sided printing is performed, and in cases where this curl would tend to result in the recording media 115 wrapping onto the image bearing member 116, which is a photosensitive drum or the like (cases in which the recording media curls towards the image bearing body 116), the greater the curl, the less readily the recording media separates from the image bearing member 116, and there is a risk of the recording media 115 being wrapping onto the image bearing member 116 and causing problems such as jams.

Such problems can be effectively solved, for example, by applying a voltage of a polarity opposite to that of the transfer current to the separation needles 102, 110 in the separation means 100, 108 shown in FIG. 8 and FIG. 10, so as to generate a corona discharge between the separation needles 102, 110 and the image bearing member 113, 114, whereby the charge is removed from the recording media 111, 112 and the recording media 111, 112 separates more efficiently from the image bearing member 113, 114.

However, with these separation means 100 as shown in FIG. 8, if the upstream wall 104 and the downstream wall 106 are formed from an insulating resin, the upstream wall 104 and the downstream wall 106, which are made from the insulating resin, are charged by the corona discharge generated between the separation needles 102 and the image bearing body 113, as a result of which the electrical fields surrounding the plurality of separation needles 102 (the electrical fields in the paper travel transverse direction) are not uniform, but rather depend on the position thereof in the paper travel transverse direction. At this point, if an attempt is made to produce the desired separation function with the recording media 111 by increasing the voltage applied to the separation needles 102, there is a risk of abnormal discharge between the separation needles 102 and the image bearing member 113, resulting in damage to the insulation of the image bearing member 113, which is a photosensitive drum or the like.

Likewise, with the separation means 108 as shown in FIG. 10, when predetermined values are used for the gap between the separation needle 110 and the image bearing member 114 and the like, so as to generate a discharge current, separation conditions vary depending on the voltage that is applied to the transfer charger 109 and the separation needle 110, which is unstable.

Here, the present invention provides an image forming device in which damage to insulation on the image bearing member is prevented by decreasing the discharge voltage by way of increasing the discharge efficiency of the separation means, and by improving the uniformity of the discharge from the separation means in the paper travel transverse direction, and the recording media separates well from the image bearing body.

SUMMARY OF THE INVENTION

The invention according to a first aspect includes: (1) a rotating toner bearing member for bearing a toner image; (2) a transfer means for applying a transfer current to a sheet of recording media that passes between this transfer means and the image bearing member so as to transfer the toner image to the recording media; and (3) a separation means, located downstream from the transfer means in the direction of transport of the recording media, for applying a separation voltage to a plurality of separation needles disposed in an alignment orthogonal to the direction of transport of the recording media, so as to produce a discharge between the image bearing member and the separation needles and remove the charge from the recording media that was charged by the transfer means, so that the recording media separates from the image bearing member. Therein, the separation means comprise a discharge separation holder for accommodating the separation needles at the interior there of.

Furthermore, this discharge separation holder comprises an upstream wall located at a position distant from the separation needles, upstream in the direction of transport of the recording media, and a downstream wall located at a position distant from the separation needles, downstream in the direction of transport of the recording media. In addition, a ground electrode is disposed on the back side of the downstream wall, which is the side not facing the separation needles, and protruding towards the image bearing member beyond the line that connects the tips of the separation needles and the end of the downstream wall.

The invention according to a second aspect is the image forming device according to the first aspect, wherein the distance between the separation needles is W1 (mm) and the separation needles are disposed so that $7 \geqq W1 \geqq 2$.

The invention according to a third aspect is the image forming device according to the first aspect, wherein a rib is disposed between the plurality of separation needles for guiding the transport of the recording media so that the recording media is not caught by the separation needles, the separation needles and the rib of being disposed so that the minimum distance between the rib and the tips of the separation needles is 1 mm to 4 mm.

The invention according to a fourth aspect is the image forming device according to the first aspect, wherein the image bearing member is formed from amorphous silicone.

By virtue of the present invention, discharge can be stabilized and discharge voltage can be lowered by improving the discharge efficiency of the separation means, and discharge can be made uniform in the paper travel transverse direction, whereby it is possible to prevent image quality loss (formation of black spots) resulting from damage to the insulation of the image bearing member.

Furthermore, by virtue of the present invention, the recording media separates well from the image bearing member, allowing for the formation of high quality images, without damaging the image before fixing.

BRIEF DESCRIPTION OF THE DRAWINGS

FIG. 6 is a figure showing a table of experimental results for structures of the separation means in the direction of sheet transport.

FIG. 7 is a figure showing a table of experimental results for structures of the separation means in the paper travel transverse direction.

DETAILED DESCRIPTION OF THE PREFERRED EMBODIMENTS

Hereinafter a mode of embodiment of the present invention is described in detail with reference to the drawings.

(Structure of the Image Forming Device)

Figure 1:
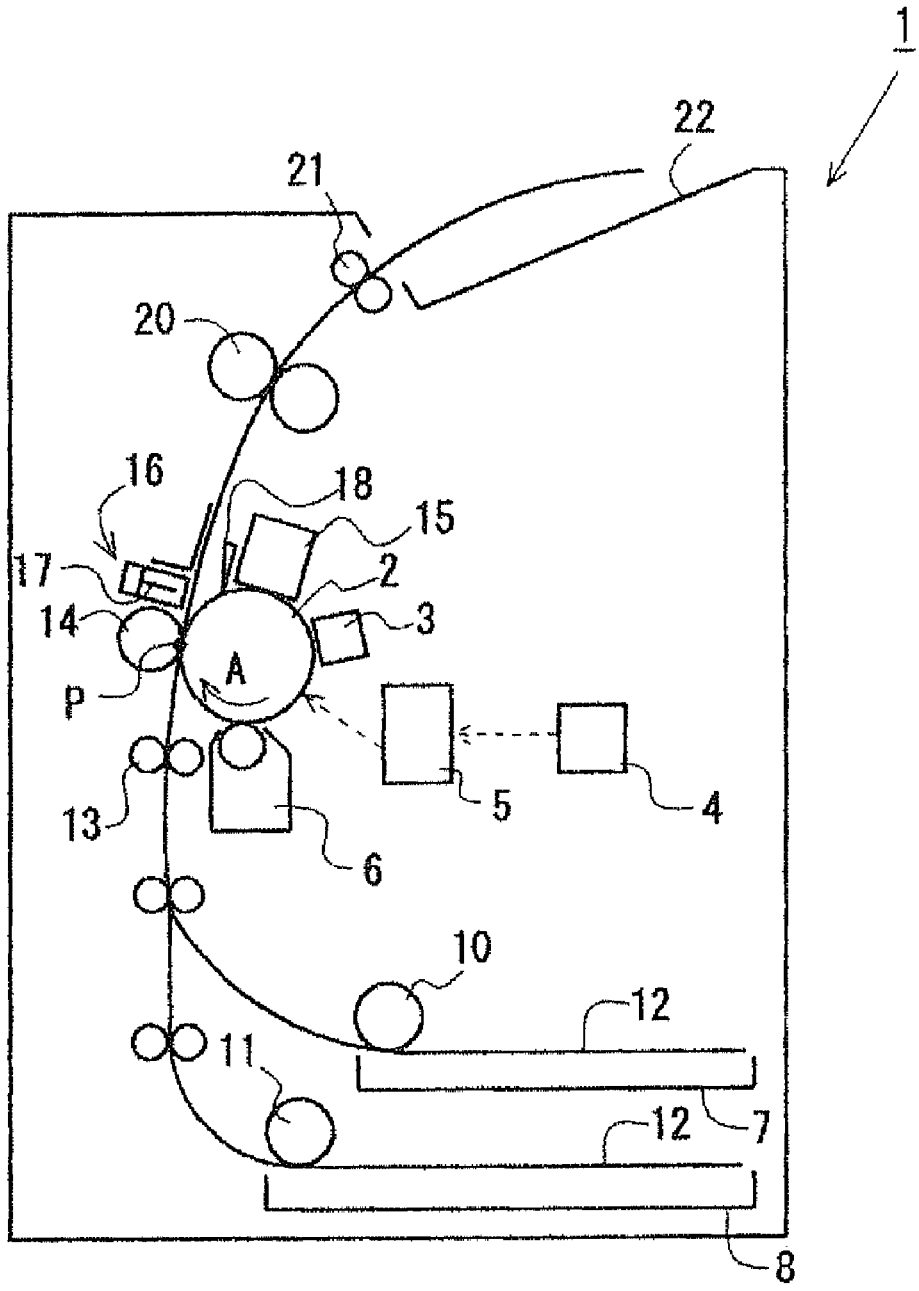
FIG. 1 is a schematic block diagram of an image forming device according to a mode of embodiment of the present invention.

FIG. 1 schematically illustrates the structure of an image forming device 1 according to a mode of embodiment; in this FIG. 1, a photosensitive drum 2 (image bearing member) rotates in the direction of an arrow A, is uniformly charged by a charging means 3, and is irradiated by laser light by an exposure means 5, which operates on the basis of a control signal from a control means 4, so that an electrostatic latent image is formed on the surface thereof, whereafter toner is supplied to this surface as a developing agent by a developing means 6, so that the electrostatic latent image is made visible as a toner image.

Next, a sheet of recording media (such as copy paper or plastic film, referred to herein below simply as a sheet) 12 is fed from a paper tray 7 or 8 by a paper feed roller 10 or 11, and fed to a transfer position P between a photosensitive drum 2 and a transfer roller (transfer means) 14, by resist rollers 13. The transfer roller 14 applies a transfer bias having a polarity opposite to that of the toner to the sheet 12 so as to transfer the toner image that has adhered to the surface of the photosensitive drum 2 to the sheet 12 at a transfer position (a nip between the photosensitive drum 2 and the transfer roller 14 in the present mode of embodiment). Note that toner that does not transfer to the sheet 12 but remains on the surface of the photosensitive drum 2 is a removed by a cleaning means 15. Amorphous silicone is used for the photosensitive drum 2.

A separation means 16 is disposed at a predetermined position downstream, in the direction of sheet transport, from the transfer position P. This separation means 16 removes the charge from the sheet 12 and causes it to separate from the photosensitive drum 2 by generating corona discharge between the separation means 16 and the photosensitive drum 2 as a result of applying a separation voltage to separation needles (a separation electrode unit) 17 as described in more detail below. Furthermore, a separation claw 18, for separating sheets 12 that could not be separated by the separation means 16 by peeling them off from the surface of photosensitive drum 2, is disposed between the separation means 16 and the cleaning means 15 at the periphery of the photosensitive drum 2.

The sheet 12, which has been separated from the photosensitive drum 2 by way of charge removal by the separation means 16, is fed to a fixing means 20 where the toner is fixed by applying heat and pressure with the fixing means 20. Next, sheets that have been fed out from the fixing means 20 are output to an output tray 22 by output rollers 21, and stacked in the output tray 22.

Figure 2:
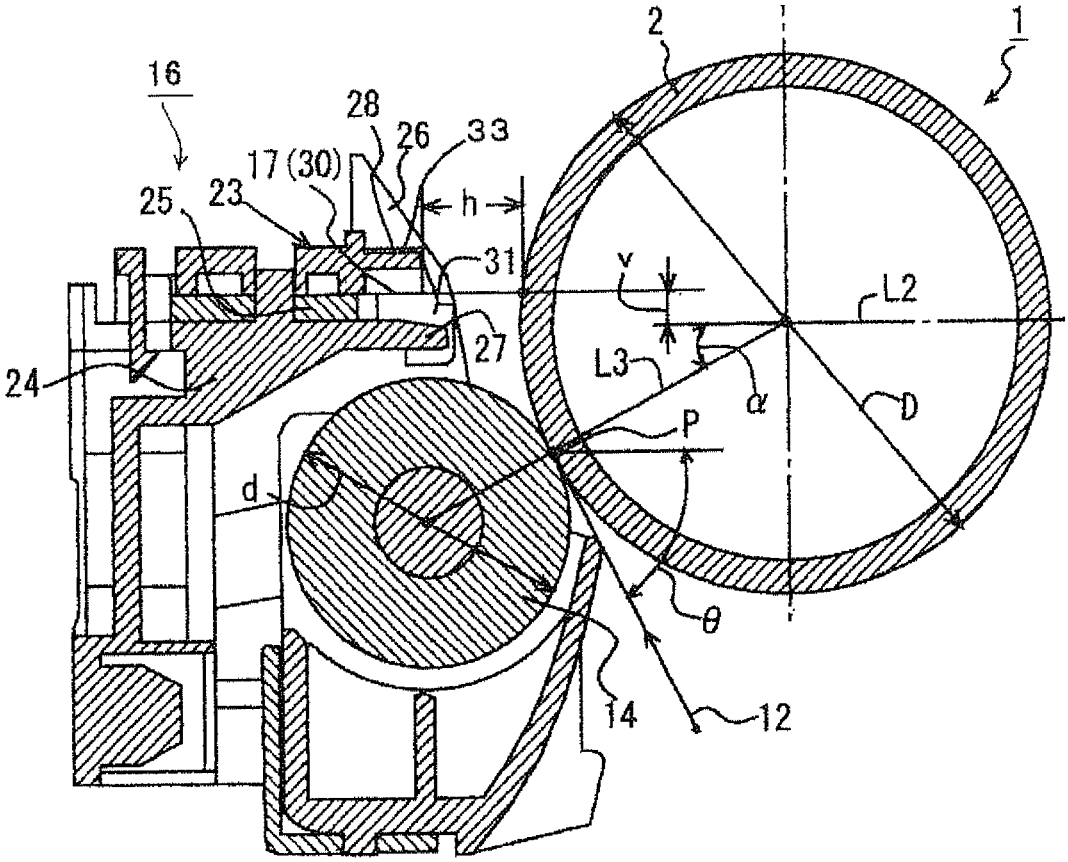
FIG. 2 is a block diagram showing the relationship between a separation means, a photosensitive drum and a transfer roller.

FIG. 2 is a detailed view of the separation means 16. In FIG. 2, the separation means 16 are such that separation needles 17 are held in a charge removal separation unit holder 23. This charge removal separation unit holder 23 comprises a transfer housing 24, which rotatably supports the transfer roller 14, a flat spacer 25 and a transport guide 26. Furthermore the charge removal separation unit holder 23 is such that the spacer 25 is affixed to the upstream wall 27 of the transfer housing 24 and the charge removal separation unit holder 23 holds a substantially flat separation electrode unit 30 trapped between this spacer 25 and the downstream wall 28 of the transport guide 26.

In the present mode of embodiment, on the back side of the downstream wall 28, which is the side that does not face the separation needles 17, a ground electrode 33 is disposed so as to protrude towards the photosensitive drum 2, beyond the line connecting the tips of the separation needles 17 and the end of the downstream wall 28. Thus, no barrier is present on the path of the straight-line that connects the tip of the ground electrode 33 and the tips of the separation needles 17.

The separation electrode unit 30 is formed from an electrically conductive material (such as SUS 304 steel) and has a lengthwise dimension at least equal to the paper travel transverse dimension (the dimension in the direction orthogonal to the direction of transport of the sheet 12) of the largest sized sheet 12 that can be printed. At the edge of this separation electrode unit 30 that faces the photosensitive drum 2, are formed a plurality of protruding separation needles 17 in the paper travel transverse direction (see FIG. 3). These separation needles 17 are substantially triangular when viewed along the paper passage direction (see FIG. 3) and converge in the direction of the photosensitive drum 2, so as to produce a discharge between the tips thereof and the photosensitive drum 2.

Figure 3:
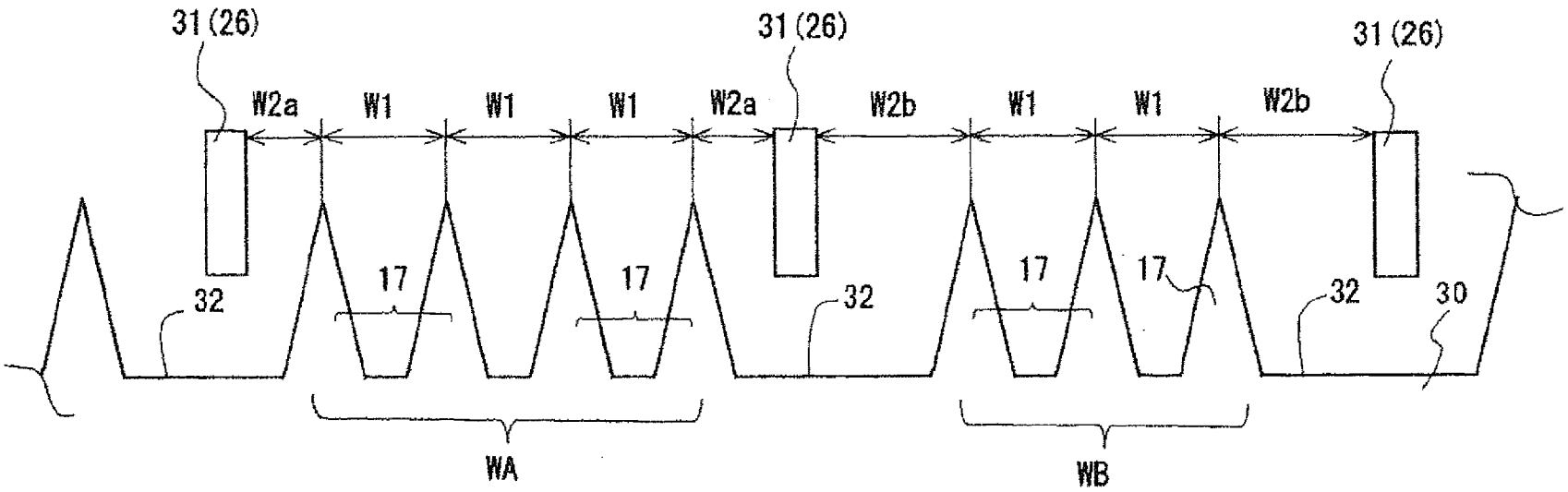
FIG. 3 is a front view of a separation needle, showing the shape of the separation needle in a separation means as viewed from a direction orthogonal to the direction of sheet transport.

The tips of the these separation needles 17 are disposed at a position that is vertically higher than the axis of rotation of the photosensitive drum 2 (substantially downstream in the sheet transport direction) by a distance of v=0.05 to 0.06 (preferably v=0.057), where the diameter of the photosensitive drum 2 is 1, and that is distant from the surface of the photosensitive drum 2 in the horizontal direction by h=0.18 to 0.27 (preferably, h=0.21). Furthermore, the optimal value for the measurement W1 between adjacent separation needles 17, as shown in FIG. 3, was determined by experimentation as described hereinbelow.

The base end of the ground electrode 33 is connected to a grounding part (not shown) in the main body of the device and has a leading edge which protrudes in the direction of the photosensitive drum 2 beyond the downstream wall 28, and as seen from the direction of passage of the paper, forms a flat plate. This ground electrode 33 may be cut away as necessary so as not to interfere with the transport guide 26. This ground electrode 33 allows for dissipation of the electrostatic charge accumulated in the charge removal separation unit holder 23, facilitates corona discharge between the separation needles 17 and the photosensitive drum 2, increases discharge efficiency, and allows for improved discharge uniformity while allowing a lower discharge voltage to be applied to the separation needles 17. Next, the tip of the ground electrode 33 protrudes beyond the forward edge of the downstream wall 28 to an extent such that it can be seen from the tips of the separation needles 17, and no barrier is present on the straight-line that connects the tip of the ground electrode 33 and the tips of the separation needles 17. However, the tip of the ground electrode 33 does not extend to such an extent as to protrude towards the photosensitive drum 2 beyond the transport guide 26, so that the tip of the ground electrode 33 and the sheet 12 do not touch. This is because, the ground electrode 33 touching the sheet 12 would have a negative impact on the transport stability of the sheet 12.

Figure 4:
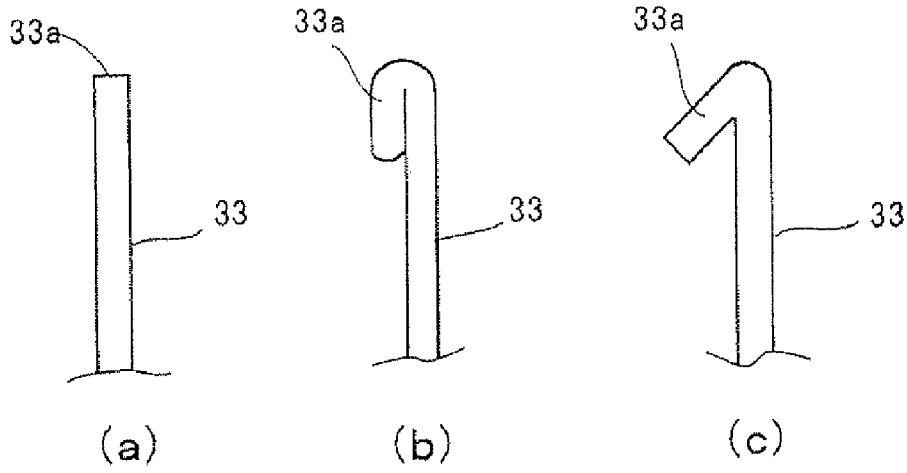
FIGS. 4 (*a*), (*b*) and (*c*) are views showing the sectional shapes of ground electrode tips.

FIGS. 4 (*a*) to (*c*) show sectional shapes for the tip of this ground electrode 33; as shown in FIG. 4 (*a*), the shape of the tip 33*a* may be produced by cutting it and rounding the corners, but it is preferable that the shape of the tip 33*a* be produced by folding it towards the outside and laying it close against itself (hemming bend) as shown in FIG. 4 (*b*), or by bending the tip 33*a* towards the outside at an acute angle (acute bend), as shown in FIG. 4 (*c*). This is because, as compared to cutting and rounding the corners, the hemming bend and the acute angle bend allow for greater stability.

Note that if the tip 33*a* of the ground electrode of 33 is to have a simple cut shape, it may be substantially triangular as seen from the direction of passage of the paper, in the same manner as the separation needles 17. Furthermore, in the present mode of embodiment, a case is being described wherein the ground terminal 33 is disposed on the downstream wall 28, but the present invention is not limited thereto, and the ground electrode 33 may be disposed on the upstream wall 27, so long as there is no risk of shorting the transfer current applied to the transfer roller 14.

The transport guide 26 has a plurality of ribs 31 which extend in the sheet transport direction and corresponds to the paper travel transverse direction sizes of the sheets 12 (paper travel transverse direction sizes such as: postcard size, B5, A4, B4 and A3) (see FIG. 3). A plurality of these ribs 31 are disposed on the transport guide 26 in the paper travel transverse direction so as to correspond to the sizes of the sheets 12 that are used in printing, so as to support the various sizes of sheets 12 that are transported (used in printing) so that the sheets 12 do not touch the separation needles 17. The ribs 31 on the transport guide 26 are disposed so as to fit into cutaways 32 between the separation needles 17, and the optimal values for the measurements W2*a* and W2*b* in the paper travel transverse direction, with respect to the tips of the separation needles 17, as shown in FIG. 3, were found by experimentation as described hereinbelow.

(Structure of the Separation Means in the Sheet Transport Direction)

Next, an explanation will be given of the manner in which the discharge voltage applied to the separation needles 17 was reduced and the discharge made uniform in the paper travel transverse direction of the separation needles 17 in the separation means 16, so as to prevent damage to the insulation on the photosensitive drum 2, and of the manner in which separation of the sheet 12 from the photosensitive drum 2 was made possible without the user injuring himself on the separation needles 17 of the separation means 16, when dealing with jams or the like. Note that, in studying the structure of the separation means in the direction of sheet transport, the measurements for W1, W2*a* and W2*b*, as shown in FIG. 3, were established so that W1=4 mm, and W2*a* and W2*b*=1 to 4 mm.

Figure 5:
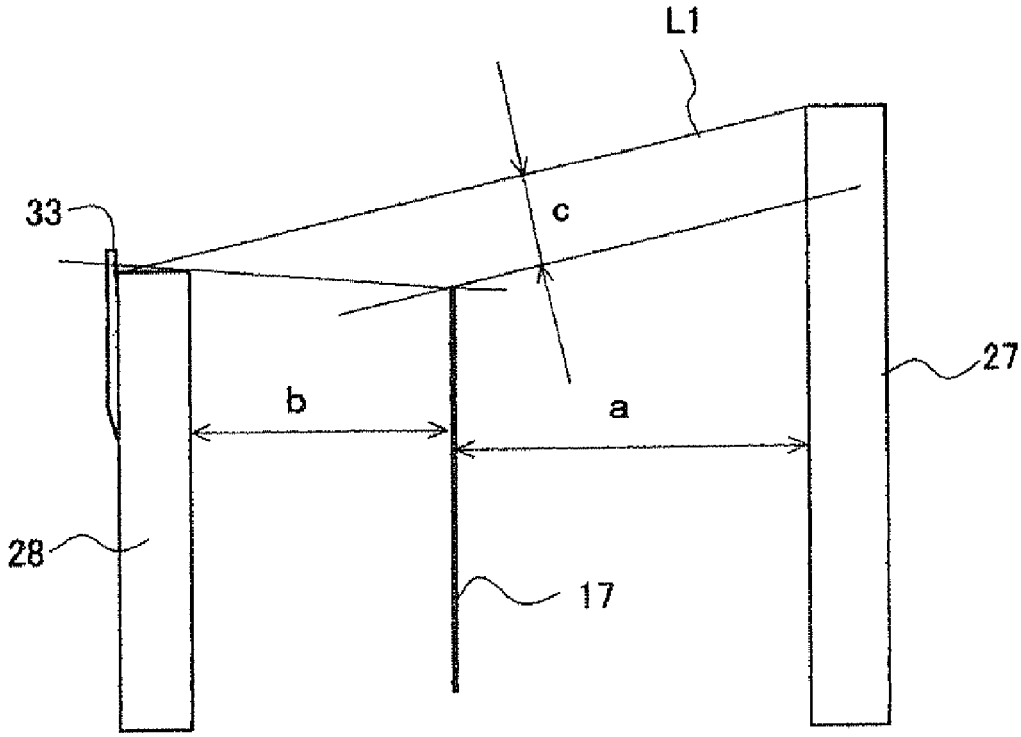
FIG. 5 is a diagram showing the spatial relationship between an upstream wall, a downstream wall and a separation needle.
Figure 8:
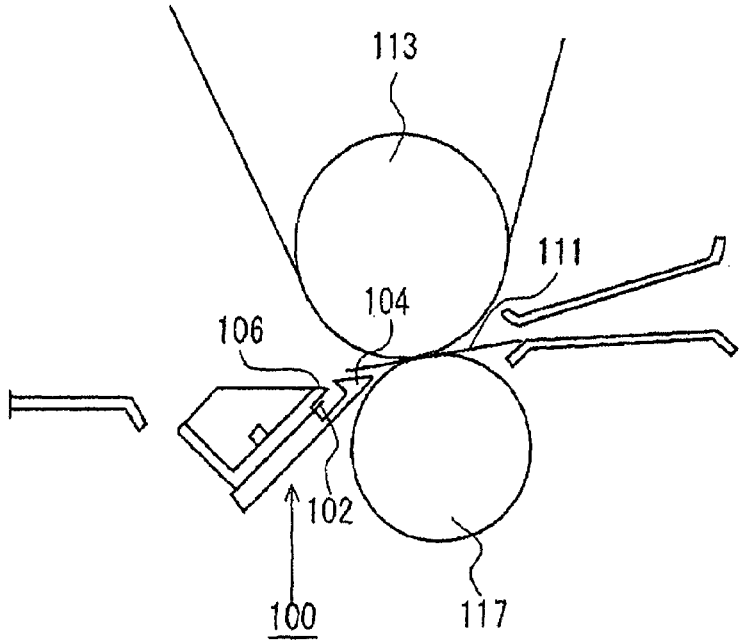
(PRIOR ART) Fig. 8
FIG. 8 is a structural diagram of an image forming device, representing a first conventional example.
Figure 9:
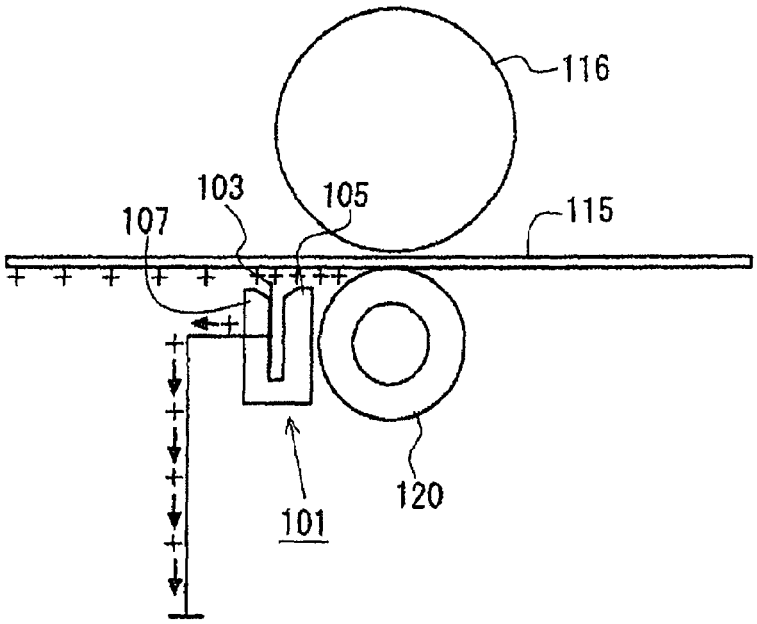
(PRIOR ART) Fig. 9
FIG. 9 is a structural diagram of an image forming device, representing a second conventional example.
Figure 10:
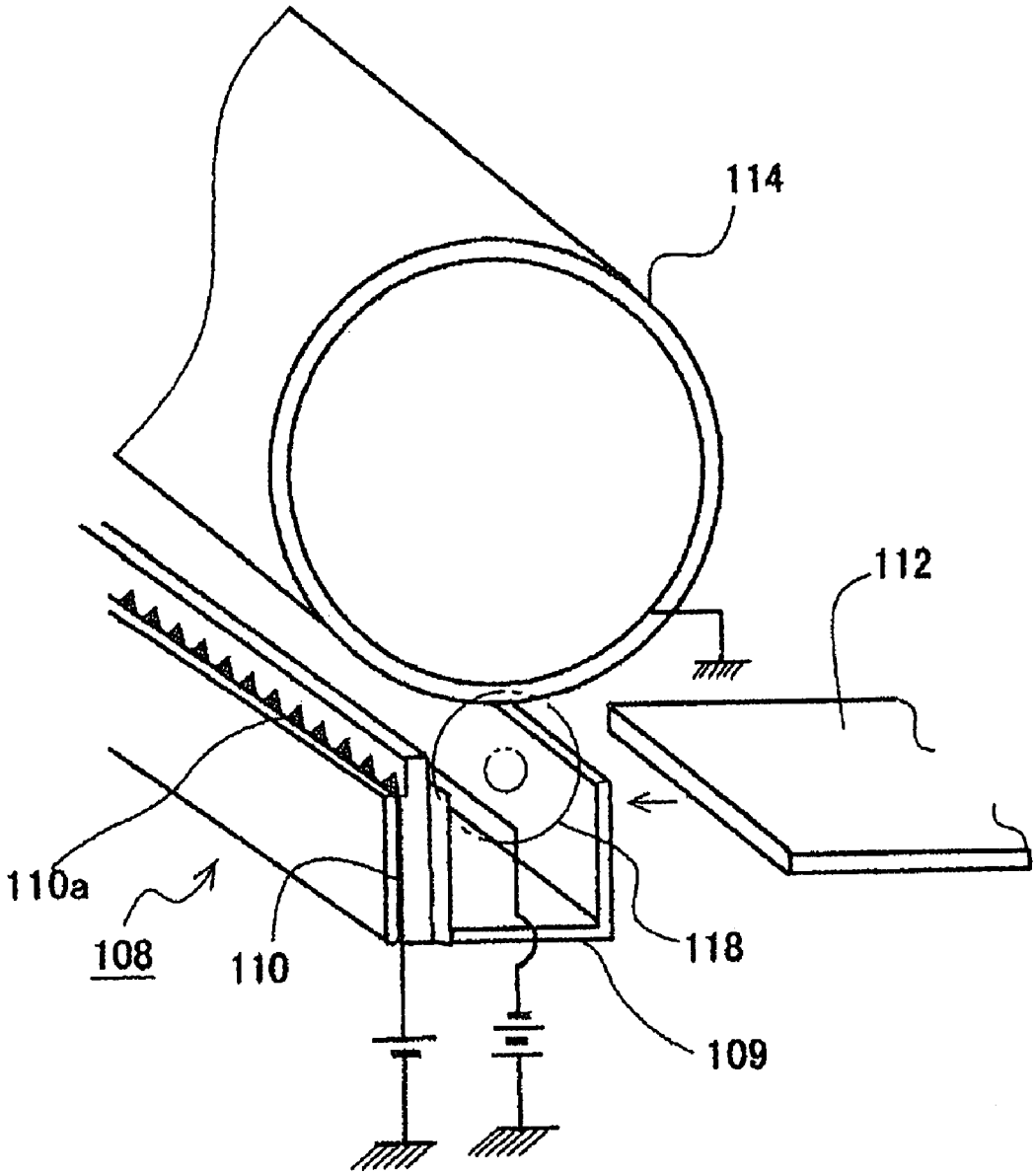
(PRIOR ART) Fig. 10
FIG. 10 is a structural diagram of an image forming device, representing a third conventional example.

First, FIG. 5 is a drawing illustrating the relationship between the upstream wall 27, the downstream wall 28, the separation needles 17 and the ground electrode 33. In FIG. 5, the spatial relationships between the separation needles 17, the upstream wall 27 and the downstream wall 28 are such that, the shortest distance between the upstream wall 27 and a separation needle 17 is given as a (mm) and the shortest distance between the downstream wall 28 and a separation needle 17 is given as b (mm), while the shortest distance between a separation needle 17 (tip of the separation needle 17) and a line L1 that connects the end of the upstream wall 27 and the end of the downstream wall 28 is given as c (mm). Furthermore, on the back side of the downstream wall 28, which is the side that does not face the separation needles 17, the ground terminal 33 is disposed so as to protrude towards the photosensitive drum 2 beyond the line connecting the tip of the separation needles 17 and the end of the downstream wall 28.

Next, the results of measurements for safety when dealing with a jam, separability of the sheet from the photosensitive drum 2 and the working life of the photosensitive drum 2 as based on the occurrence of black spots due to insulation damage, with and without a ground electrode 33, and when each of the measurements a, b, and c were varied, are shown in the table in FIG. 6.

Safety, as shown in the table in FIG. 6, was evaluated by whether or not a finger of a user could be inserted between the upstream wall 27 and the downstream wall 28 when dealing with a jam; not being able to insert a finger between the upstream wall 27 and the downstream wall 28 was evaluated as "good," and when there was a risk of the user inserting a finger between the upstream wall 27 and the downstream wall 28 and injuring himself, this was evaluated as "poor."

Furthermore, separability as shown in the table in FIG. 6 was evaluated as "poor" when claw tracks from the separation claw 18 were left on the toner image that was transferred to the sheet 12, due to the separation claw 18 striking the sheet 12 after transfer, as this caused the damage to the transferred toner image, and separability was evaluated as "good" when they were in no claw tracks from the separation claw 18 on the toner image that had been transferred to the sheet 12.

Furthermore, the working life (working life depending on insulation damage), as shown in the table in FIG. 6, was rated as "very good" when the discharging separation electrode unit 30 was greater than or equal to 80% and as "good" when the discharging separation electrode unit 30 was greater than or equal to 60% and less than 80%. These ratings of "very good" and "good" both indicate that black spots did not form on the image as a result of insulation damage. Furthermore, when the discharging separation electrode unit 30 was less than or equal to 30%, this was rated as "poor" because black spots clearly formed on the image as a result of insulation damage. Furthermore, when the discharging separation electrode unit 30 was greater than 30% and less than 60%, this was rated as "fair" because there was a risk of black spots forming on the image as a result of insulation damage.

A protective layer that serves to maintain electric charge is provided on the surface of the amorphous silicone photosensitive drum 2 used in the present mode of embodiment. This protective layer on the photosensitive drum 2 has a thickness of approximately 1 μm and a breakdown voltage of several hundred volts. That is to say, it is known that, as compared to a thick-layered organic photosensitive drum, insulation damage readily occurs, so that precise design is required. With such a photosensitive drum 2, when the protective layer is damaged, it is no longer possible to maintain an electric charge on the surface thereof, and therefore toner adheres to the place in which the electric charge cannot be maintained, so that undesired black spots form in the image, which shortens the working life.

As shown under the heading "Embodiments" in the table in FIG. 6, in cases where the image forming device 1 has a ground electrode 33, if a constitution is adopted that fulfills the conditions $a \geqq 0.5$ and $b \geqq 1$, while $4 \geqq a+b \geqq 2$ and fulfills a condition $2 \geqq c \geqq 0$, it is possible to achieve good effects in terms of safety, separation and working life (working life depending on insulation damage). Note that, in comparative example 1, wherein a ground electrode 33 is not used, even under the same conditions where a ground electrode 33 is used, the device was not suitable (rated as "poor") in terms of safety, separation and working life (working life depending on insulation damage), and the desired effect could not be achieved. Furthermore, in comparative example 2, even if a ground electrode 33 is used, if the aforementioned conditions are not satisfied, the device is not suitable (rates as "poor") in terms of safety, separation and working life. From these experiments it has been made clear that, other conditions being the same, a better effect can be achieved when a ground electrode 33 is provided than when one is not provided.

(Structure of the Separation Means in the Sheet Travel Transverse Direction)

Furthermore, in the present mode of embodiment, the ground electrode 33 is mounted on the back side of the downstream wall 28, and experiments were made regarding the size of the gap between adjacent separation needles 17 of the separation means 16, which are disposed at predetermined intervals in the paper travel transverse direction, and regarding the voltage applied, so as to increase the discharge efficiency of the separation needles 17 and so as to improve the separation of the sheet 12 from the photosensitive drum 2; and the results of these experiments were applied to the image forming device 1. Note that, in the experiments, the measurements for the dimensions a, b and c in FIG. 5 were, a=2 mm, b=2 mm and c=0 mm.

First, the table in FIG. 7 shows results of measurements for separation characteristics and discharge uniformity when the discharge output applied to the separation needles 17 was 40 μA and changes were made to the measurement W1 between adjacent separation needles 17, as well as to the discharge voltage applied, and to whether or not a ground electrode 33 was used. In the table, separation was determined according to the transport characteristics of the sheet 12, and whether or not this separated was determined using sheets 12 onto which transfer had not been performed. Discharge uniformity was determined by measuring discharge distribution in the axial direction of an aluminum tube, which was used as electrode for the separation means 16.

As shown in the table in FIG. 7, if the distance between adjacent separation needles 17 is given as W1 (mm), the greater the value of W1, the lower the discharge voltage can be. Furthermore, if a ground electrode 33 is provided, the discharge voltage can be reduced by approximately 500 V with the same measurement W1, as compared to the case in which a ground electrode 33 is not provided. The possibility of reducing the discharge voltage allows for better quality image formation because of a corresponding decrease in the probability of black spots occurring as a result of damage to the insulation.

Furthermore, if the measurement W1 between adjacent separation needles 17 satisfies 7≧W1≧2, the sheet 12 separates well from the photosensitive drum 2 after transfer and the discharge is uniform. For example, while a ground electrode 33 was used in both comparative example 1 (W1=1) and the embodiment (W1=2), in comparative example 1 (W1=1) the conditions for W1 were not met and the uniformity of the discharge was unsuitable (rated as "poor"), but in the embodiment (W1=2), in which the conditions for W1 were met, the results, including discharge uniformity, were OK. Furthermore, in comparative example 1 (W1=2), even though the conditions for W1 were satisfied, the discharge uniformity was unsuitable (rated as "poor") because a ground electrode 33 was not used. Furthermore, while a ground electrode 33 was used in both comparative example 2 (W1=8) and the embodiment (W1=7), in comparative example 2 (W1=8) the conditions for W1 were not met and the separation was unsuitable (rated as "poor"), but in the embodiment (W1=7), in which the conditions for W1 were met, the results, including discharge uniformity, were OK. From these experiments, it has been made clear that, other conditions being the same, a better effect can be achieved when a ground electrode 33 is provided than when one is not provided.

In the mode of embodiment described above, it is possible to further improve safety by choosing a shape for the tip of the ground electrode 33 that is not sharp, such as an acute angle or a hemming bend, in which the tip is, for example, folded through approximately 180° to the exterior, and laid a close against itself. Furthermore, because the separation needles 17 are formed as a single body of substantially triangular separation needles 17 on the flat separation electrode 30, the number of parts can be reduced and the assembly work simplified, as compared with cases wherein each of the separation needles 17 is formed separately.

EXAMPLE 1

One embodiment of the present invention is described with reference to FIG. 2. In the present embodiment, the diameter D of the amorphous silicone photosensitive drum 2 is a 40 mm and the diameter d of the transfer roller 14 is 21.5 mm. Next, the transfer roller 14 bites into the photosensitive drum 2 by about 0.2 mm so as to form a nip P between the transfer roller 14 and the photosensitive drum 2, this nip P being the transfer position. The transfer roller 14 is formed from a material (for example, EPDM to which electroconductive carbon black or the like has been added) having electrical resistance of 7.0 (log Ω) and a rubber hardness (ASCA C) of 35°.

Furthermore, in FIG. 2, the angle α formed between the horizontal line L2 and the line L3 connecting the center of rotation of the photosensitive drum 2 and the center of rotation of the transfer roller 14 is a 30° angle while the angle θ at which the sheet 12 is introduced to the nip P is a 60° angle. Next, the tips of the separation needles 17 are positioned at a distance of v=2.29 mm in the perpendicular direction from the center of rotation of the photosensitive drums 2 and at a distance of h=7.43 mm in the horizontal direction from the surface of the photosensitive drum 2. Furthermore, the ground electrode 33 is disposed on the side of the downstream wall 28 that does not face the separation needles 17.

Next, the settings are such that the photosensitive drum 2 rotates at a linear speed of 178 mm/second, the surface potential in the development position of the photosensitive drum 2 is 250 V; the transfer output is 50 μA (constant current), the separation output applied to the separation needles 17 is 40 μA (constant current) and approximately 4.8 kV. For the developing bias, 150 V DC, and 1.7 V·3 kHz AC are applied.

Furthermore, the relationship between the upstream wall 27, the downstream wall 28 and the separation needles 17 was such that for the measurement shown in FIG. 5, a was 2 mm, b was 2 mm, a+b=4 mm, and c was 0 mm. Furthermore, the measurement W1 shown in FIG. 3 was 4 mm.

The image forming device 1 of the present embodiment, which is constituted in this manner, allows the discharge voltage applied to the separation needles 17 to be 5.5 kV or less and allows the discharge from the separation needles 17 in the separation means 16 to be made uniform in the paper travel transverse direction, which effectively prevents insulation damage in the amorphous silicone photosensitive drum 2. Moreover, by virtue of the image forming device 1 of the present embodiment, the sheet 12 separates well from the photosensitive drum 2 by way of charge removal allowing for formation of high-quality images without damage to the image prior to fixing. In addition, by virtue of the image forming device 1 according to the present embodiment, users can be prevented from injuring themselves with the separation needles 17 of the separation means 16 during maintenance or the like. In other words, by virtue of the present embodiment, it is possible to supply an image forming device 1 that allows for the formation of high-quality images with excellent safety and separation characteristics and with no risk of damage to insulation.

Note that, the values indicated in the present embodiment represent one example of the present invention, and the present invention is not limited in thereto.

What is claimed is:

1. An image forming device comprising:

a rotating toner image bearing member for bearing a toner image;

a transfer means for applying a transfer current to a sheet of recording media that passes between the transfer means and the image bearing member so as to transfer the toner image to the recording media; and a separation means, located downstream from the transfer means in the direction of transport of the recording media, for applying a separation voltage to a plurality of separation needles disposed in an alignment orthogonal to the direction of transport of the recording media, so as to produce a discharge between the image bearing member and the separation needles and remove the charge from the recording media that was charged by the transfer means, so that the recording media separates from the image bearing member, the separation means comprising a charge removal separation unit holder for accommodating the separation needles at the interior thereof, the charge removal separation holder comprising an upstream wall located at a position distant from the separation needles, upstream in the direction of transport of the recording media, and a downstream wall located at a position distant from the separation needles, downstream in the direction of transport of the recording media, and a ground electrode being disposed on the back side of the downstream wall, which is the side not facing the separation needles, and protruding towards the image bearing member beyond the line that connects the tips of the separation needles and the end of the downstream wall.

2. The image forming device recited in claim 1, wherein the distance between the separation needles is W1 (mm) and the separation needles are disposed so that $7 \geqq W1 \geqq 2$.

3. The image forming device recited in claim 1, wherein a rib is disposed between the plurality of separation needles for guiding the transport of the recording media so that the recording media are not caught by the separation needles, the separation needles and the rib of being disposed so that the minimum distance between the rib and the tips of the separation needles is 1 mm to 4 mm.

4. The image forming device recited in claim 1, wherein the image bearing member is formed from amorphous silicone.

5. An image forming device comprising:

a rotating toner image bearing member being configured to bear a toner image;

a transfer roller being configured to apply a transfer current to a sheet of recording media passing between the transfer roller and the image bearing member to transfer the toner image to the recording media; and a separation device being located downstream from the transfer roller in the direction of transport of the recording media, the separation device being configured to apply a separation voltage to a plurality of separation needles disposed in an alignment orthogonal to the direction of transport of the recording media to produce a discharge between the image bearing member and the separation needles and to remove the charge from the recording media charged by the transfer roller separating the recording media from the image bearing member, the separation device having a charge removal separation unit holder being configured to accommodate the separation needles at the interior thereof, the charge removal separation holder having an upstream wall located at a position distant from the separation needles and upstream in the direction of transport of the recording media, and a downstream wall located at a position distant from the separation needles and downstream in the direction of transport of the recording media, and a ground electrode being disposed on the back side of the downstream wall opposite a side facing the separation needles and protruding towards the image bearing member beyond a line connecting the tips of the separation needles and the end of the downstream wall.

6. The image forming device recited in claim 5, wherein the distance between the separation needles is W1 (mm) and the separation needles are disposed so that $7 \geqq W1 \geqq 22$.

7. The image forming device recited in claim 5, wherein a rib is disposed between the plurality of separation needles to guide the transport of the recording media so that the recording media are not caught by the separation needles, the separation needles and the rib of being disposed so that the minimum distance between the rib and the tips of the separation needles is 1 mm to 4 mm.

8. The image forming device recited in claim 5, wherein the image bearing member is formed from amorphous silicone.

9. The image forming device recited in claim 5, wherein the rotating toner image bearing member is a photosensitive drum.

* * * * *